US009248578B2

(12) United States Patent
Kobayashi et al.

(10) Patent No.: US 9,248,578 B2
(45) Date of Patent: Feb. 2, 2016

(54) ELECTRIC SHAVER

(75) Inventors: Noboru Kobayashi, Hikone (JP); Hiroaki Shimizu, Hikone (JP); Shunsuke Komori, Hikone (JP); Toshio Ikuta, Hikone (JP); Jyuzaemon Iwasaki, Nagahama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 862 days.

(21) Appl. No.: 13/049,369

(22) Filed: Mar. 16, 2011

(65) Prior Publication Data

US 2011/0232098 A1 Sep. 29, 2011

(30) Foreign Application Priority Data

Mar. 26, 2010 (JP) ..... 2010-072287

(51) Int. Cl.

| | |
|---|---|
| ***B26B 19/42*** | (2006.01) |
| ***B26B 19/38*** | (2006.01) |
| ***B26B 19/12*** | (2006.01) |
| *B26B 19/14* | (2006.01) |

(52) U.S. Cl.

CPC ..... *B26B 19/384* (2013.01); *B26B 19/12* (2013.01); *B26B 19/143* (2013.01)

(58) Field of Classification Search

CPC .... B26B 19/143; B26B 19/38; B26B 19/384; B26B 21/36; B26B 19/02; B26B 19/04; B26B 19/12; B26B 19/42

USPC ..... 30/34.2, 41.9, 43, 43.6–43.9, 45, 30/346.51, 346.55

See application file for complete search history.

(56) References Cited

U.S. PATENT DOCUMENTS

| | | | | |
|---|---|---|---|---|
| 2,281,841 | A | 5/1942 | Holsclaw | |
| 2,877,548 | A * | 3/1959 | Starre | 30/346.51 |
| 4,035,914 | A | 7/1977 | Blume et al. | |
| 4,998,352 | A | 3/1991 | Tietjens | |
| 5,857,260 | A | 1/1999 | Yamada et al. | |
| 5,867,908 | A * | 2/1999 | Van Veen et al. | 30/43.6 |
| 6,935,027 | B2 | 8/2005 | Stevens | |
| 7,540,090 | B2 * | 6/2009 | Nakano | 30/43.6 |
| 2008/0134523 | A1 | 6/2008 | Komori et al. | |
| 2011/0179648 | A1 | 7/2011 | Sakon et al. | |

FOREIGN PATENT DOCUMENTS

| | | |
|---|---|---|
| CN | 1143558 | 2/1997 |
| CN | 1470369 | 1/2004 |
| CN | 100509313 | 7/2009 |
| CN | 102166757 | 8/2011 |
| EP | 0279088 | 8/1988 |

(Continued)

OTHER PUBLICATIONS

Japan Office action, mail date is Feb. 14, 2012.

(Continued)

*Primary Examiner* — Kenneth E. Peterson
*Assistant Examiner* — Samuel A Davies
(74) *Attorney, Agent, or Firm* — Greenblum & Bernstein, P.L.C.

(57) ABSTRACT

Bars 40 include a hair raising bar 45 having a hair raising portion 45*g* raising body hair 75. A cross section of the hair raising portion 45*g* has a profile shape including connecting elements 80 which are connected, each connecting element being at least any one of a line segment 81 and an arc line 82.

9 Claims, 23 Drawing Sheets

(56) References Cited

FOREIGN PATENT DOCUMENTS

| | | | |
|---|---|---|---|
| EP | 0743144 | | 11/1996 |
| EP | 1930137 | | 6/2008 |
| FR | 1.129.944 | A | 1/1957 |
| JP | 58-117264 | | 8/1983 |
| JP | 3-267090 | | 11/1991 |
| JP | 2002-66169 | | 3/2002 |

OTHER PUBLICATIONS

Search report from E.P.O., mail date is Jul. 4, 2011.

China Office action, dated Feb. 20, 2013 along with an english translation thereof.

U.S. Appl. No. 13/009,226 to Shigetoshi Sakon et al., filed Jan. 19, 2011.

U.S. Appl. No. 13/049,138 to Jyuzaemon Iwasaki et al., filed Mar. 16, 2011.

* cited by examiner

ELECTRIC SHAVER

CROSS REFERENCE TO RELATED APPLICATIONS

This application is based upon and claims the benefit of priority from prior Japanese Patent Application P2010-072287 filed on Mar. 26, 2010; the entire contents of which are incorporated by reference herein.

BACKGROUND OF THE INVENTION

The present invention relates to an electric shaver.

Various types of electric shavers to shave body hair have been developed. Herein, the angle between the direction that a body hair extends and the skin surface is called a hair rising angle. Body hair with large hair rising angle (45° to 60°, for example) is easy to shave, but body hair with small hair rising angle (not more than 30°, for example), or flat lying body hair is difficult to shave. An electric shaver as disclosed in U.S. Pat. No. 2,877,548 has been therefore developed, which is provided with hair raising portions at bars of an outer blade. Herein, the hair raising portions have higher hair raising ability to raise the flat lying hair than that of conventional ones.

SUMMARY OF THE INVENTION

However, in the aforementioned conventional technique, each bar has a substantially parallelogram-shaped cross section, and each corners of the bar on the skin side is composed of an arc, thus forming the hair raising portion in the bar. Accordingly, the influence on the skin can be reduced, but it is difficult to efficiently raise flat lying body hair. In other words, the performance of introducing flat lying body hair to the outer blades is not good.

An object of the present invention is to provide an electric shaver with an improved performance of introducing flat lying body hair to the outer blade and reduced influence on the skin.

To achieve the aforementioned object of the present invention, an electric shaver according to the present invention includes: an outer blade including blade holes defined by bar; an inner blade which is provided inside of the outer blade and moved relative to the outer blade to cut a body hair inserted into one of the blade holes. In the electric shaver, the bars include a hair raising bar having a hair raising portion raising the body hair, and the hair raising bar includes: a skin contact surface facing skin; an inner side surface facing the blade holes or the inner blade; and a hair raising surface connecting the skin contact surface and the inner side surface. A profile shape of a cross section of the hair raising portion is formed by connecting a blade hole side edge in a cross-sectional line of the skin contact surface and a blade hole side edge in a cross-sectional line of the inner side surface with one linear connecting element or a plurality of connecting elements, and each of the plurality of connecting elements is at least any one of a line segment and an arc line.

DETAILED DESCRIPTION OF THE PREFERRED EMBODIMENTS

Hereinafter, an embodiment of the present invention will be described in detail with reference to the drawings. In the following description, the direction that a plurality of outer blades are arranged side by side is referred to as a front-back direction (a shaving direction) X, and the direction that each outer blade extends is referred to as a right-left direction Y. The vertical direction in a state where a head section is placed with the outer blade facing upward is referred to as a vertical direction Z.

Figure 1:
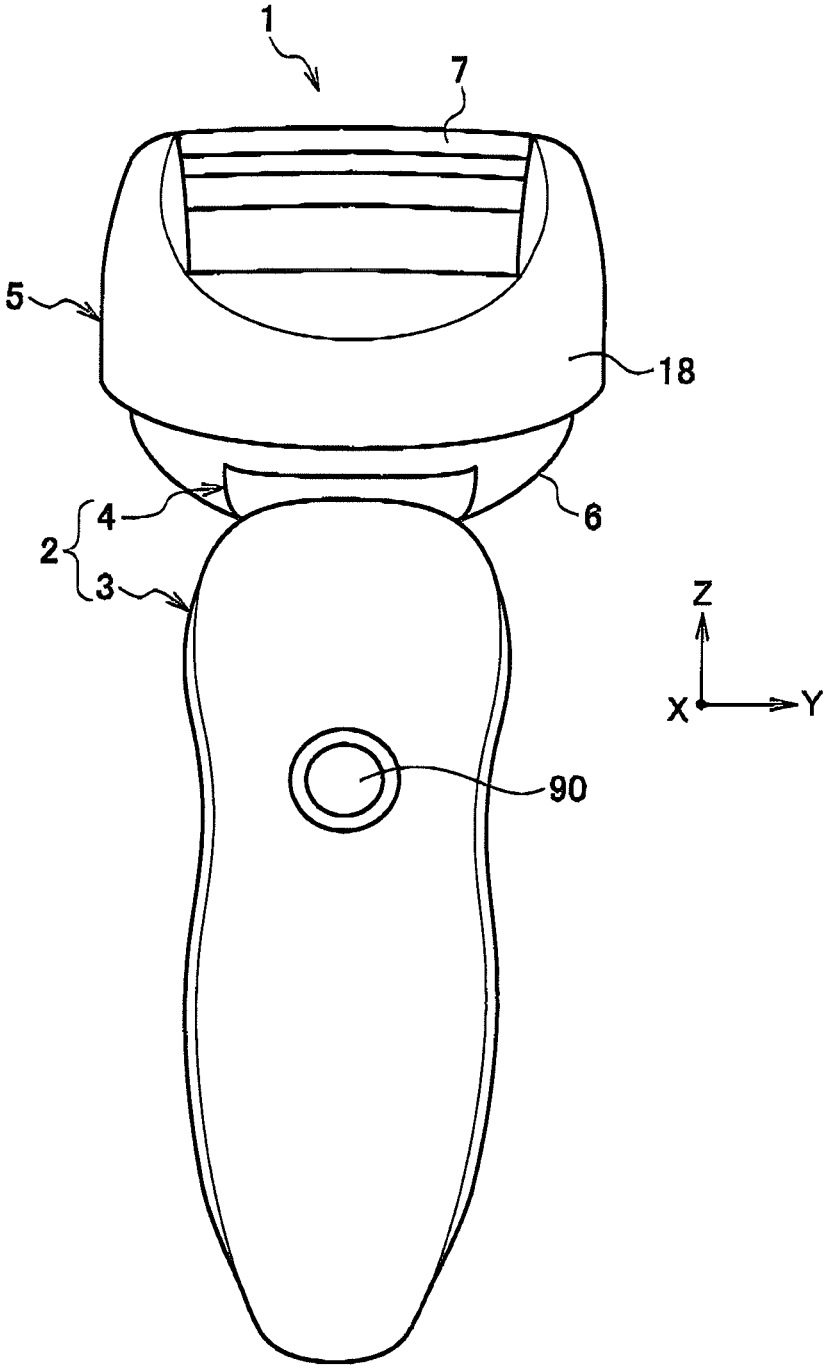
FIG. 1 is a front view showing an electric shaver according to an embodiment of the present invention.

An electric shaver 1 according to the embodiment includes a grip section 2 gripped by a hand and a head section 5 fixed to the grip section 2 as shown in FIG. 1.

The grip section 2 includes: a grip body 3 which is made of synthetic resin and incorporates a not-shown battery; and a grip joint portion 4 which is made of synthetic resin and is protruded rearward from the upper surface of the grip body 3. The head section 5 may be attached to the grip section 2 so as to swing in the right-left or front-back direction by providing at least one of a known right-left swinging mechanism and a known front-back swinging mechanism on the upper surface of the grip joint portion 4.

The head section 5 includes: a linear head portion 6 which incorporates a not-shown linear motor and is connected to the grip joint portion 4; and a blade unit 7 attached to the linear head portion 6. As shown in FIG. 1, at the grip body 3, a switch portion 90 configured to turn on and off drive of the linear motor is formed. The grip body 3 may be provided with a display portion displaying a charging state of the battery and the like.

The blade unit 7 includes outer blades 8 exposed upward in the head section 5 and inner blades 13 which are provided inside of the outer blades 8 (under the outer blades 8) and moved relative to the outer blades 8.

This embodiment is provided with four (a plurality of) outer blades: a first net blade 9, a finishing net blade 10, a slit blade 11, and a second net blade 12, which are arranged side by side in the front-back direction X.

Figure 4:
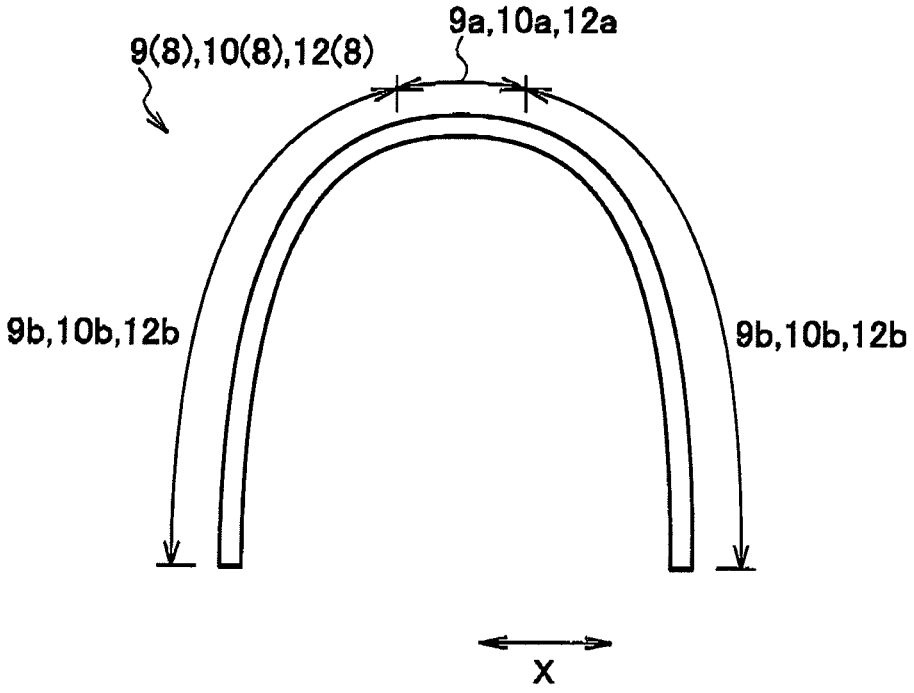
FIG. 4 is a schematic side view of an outer blade according to the embodiment of the present invention.

As shown in FIG. 4, each of the net blades 9, 10, and 12 is curved in an inverted U shape in the front-back direction (the short side direction) so as to be convex up in a side view (when each outer blade is seen in the right-left direction. Furthermore, each of the net blades 9, 10, and 12 is slightly curved in the right-left direction (the longitudinal direction) Y so as to be convex up in a front view (when each outer blade is seen in the front-back direction X). In this embodiment, the net blades 9, 10, and 12 are curved so as to be convex up in the front view but are not necessarily curved.

Figure 3:
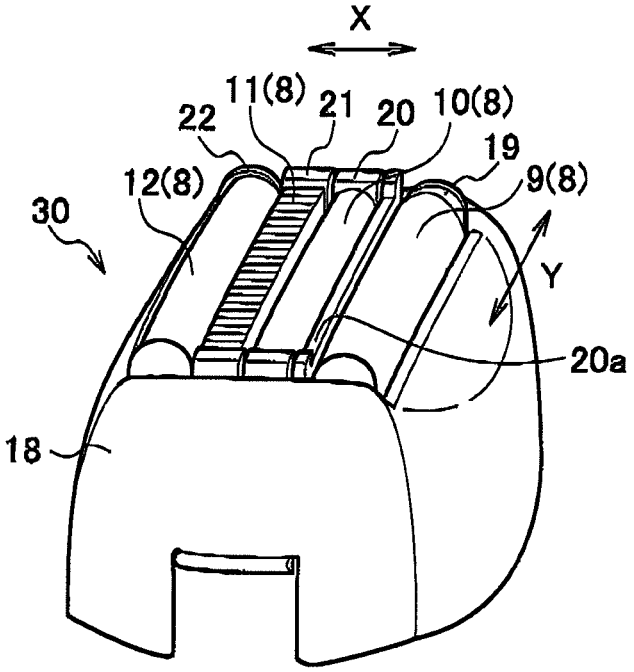
FIG. 3 is a perspective view schematically showing an outer blade cassette according to the embodiment of the present invention.

In the net blades 9, 10, and 12, a number of blade holes 50 are defined by bars 40. Furthermore, as shown in FIG. 3, in this embodiment, the blade width of the finishing net blade 10 (width in the front-back direction X) is set smaller than blade widths of the first and second net blades 9 and 12 (widths in the front-back direction X). By setting the blade width of the finishing net blade 10 smaller than the blade widths of the other net blades 9 and 12, in other words, by setting the curvature radius of the finishing net blade 10 small, skin 70 pressed against the surface is greatly protruded inside through the blade holes 50 so that body hair 71 (see FIG. 14) can be cut short.

The slit blade 11 is curved in a squared U-shape in the front-back direction (the short-side direction) and includes a number of slits (blade holes) drilled from the flat upper wall to the side walls.

To be specific, in the slit blade 11, the number of slits (blade holes) are defined by substantially squared U-shaped bars from the flat upper wall to the side walls and a bar extending along the longitudinal direction (the right-left direction) Y at the bottom of each side wall.

The net blades 9, 10, and 12 and the slit blade 11 constituting the outer blades 8 are attached to dedicated outer blade frames 19, 20, 22, and 21, respectively.

Furthermore, a skin guard member **20*a* is formed in the first net blade 9 side of the outer blade frame 20. The skin guard member 20*a* and the slit blade 11 sandwiching the finishing net blade 10 at the front and back effectively prevent the skin 70 from being strongly pressed against the finishing net blade 10** having a small curvature.

The outer blade frame 19 to which the first net blade 9 is attached, the outer blade frame 20 to which the finishing net blade 10 is attached, the outer blade frame 21 to which the slit blade 11 is attached, and the outer blade frame 22 to which the second net blade 12 is attached are individually engaged with an outer blade frame 18 to form the outer blade cassette 30. The outer blade cassette 30 is attached to the linear head portion 6.

Figure 2:
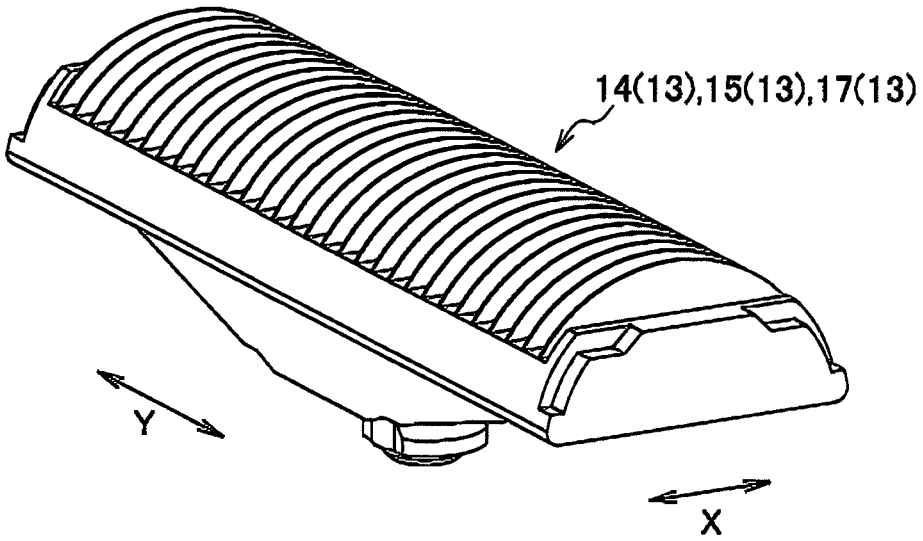
FIG. 2 is a perspective view showing inner blades according to the embodiment of the present invention.

The inner blades 13 are dedicatedly provided for the net blades 9, 10, and 12 and the slit blade 11 constituting the outer blades 8. Specifically, under (inside) the net blades 9, 10, and 12, inversed U-shape inner blades 14, 15, and 17 along the curves of the corresponding net blades 9, 10, and 12 are provided, respectively (see FIG. 2). Under (inside) the slit blade 11, a squared U-shaped slit inner blade (not-shown) along the curve of the slit blade 11 is provided.

The inner blades 14, 15, and 17 and slit inner blade (not shown) are attached to the aforementioned not-shown linear motor. If the linear motor is driven, the inner blades 14, 15, and 17 and the slit inner blade (not shown) are reciprocated in the right-left direction (longitudinal direction) Y.

By moving the inner blades 14, 15, 17 and slit inner blade (not shown) provided under (inside) the net blades 9, 10, and 12 and slit blade 11 relative to the net blades 9, 10, and 12 and slit blade 11, respectively, the body hair 71 inserted in the blade holes 50 of the net blades 9, 10, and 12 and the slits of the slit blade 11 are cut by the net blades 9, 10, and 12 and slit blade 11 in cooperation with the inner blades 14, 15, and 17 and slit inner blade (not shown).

Next, the net blades 9, 10, and 12 according to this embodiment will be described in detail.

Figure 5:
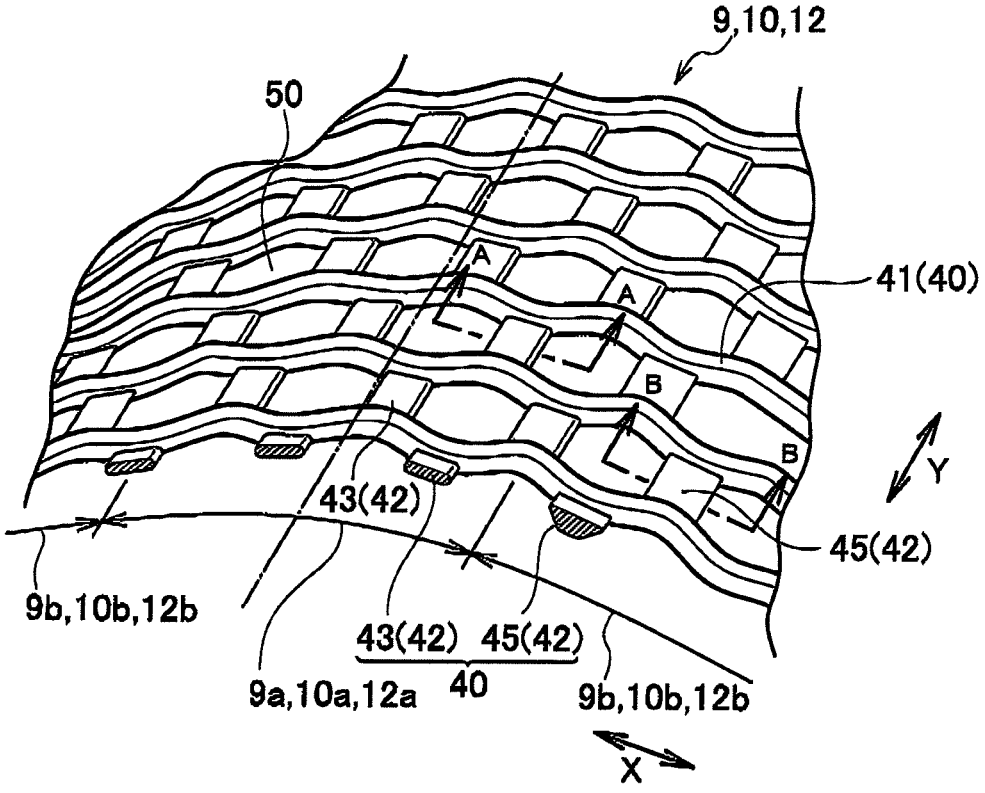
FIG. 5 is a enlarged perspective view of a part of the outer blade according to the embodiment of the present invention.

In this embodiment, in the net blades 9, 10, and 12, a number of the blade holes 50 are defined by the bars 40. Specifically, as shown in FIG. 5, the bars 40 include: short-side bars 41 extending in a wave shape in the short-side direction (front-back direction) X; and longitudinal bars 42 extending in the longitudinal direction (right-left direction) Y. These short-side and longitudinal bars 41 and 42 define the blade holes 50 substantially hexagonal in a plan view. These blade holes 50 have sufficient size to allow the body hairs 71 to be inserted therein.

In this embodiment, long-plate members 9*c*, 10*c*, and 12*c* including the number of blade holes 50 are curved in an inverted U-shape along the front-back direction (shaving direction) X so as to be convex up and are attached to the outer blade frames 19, 20, and 22 to form the net blades 9, 10, and 12 curved in an inverted U-shape in a side view, respectively.

In the net blades 9, 10, and 12 curved in the inverted U-shape in a side view, top sections 9*a*, 10*a*, and 12*a* positioned at the top have large contact pressure against the skin 70. The outside sections 9*b*, 10*b*, and 12*b* positioned on both sides of the top sections 9*a*, 10*a*, and 12*a* in the short-side direction have small contact pressure against the skin 70. The dashed-dotted line in FIG. 5 indicates a centerline passing through the center of each of the top sections 9*a*, 10*a*, and 12*a* in the short-side direction.

Figure 6A:
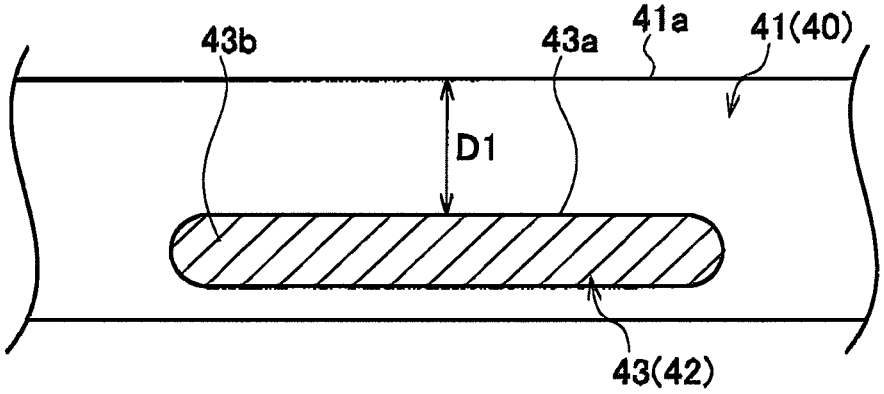
FIG. 6A is a cross-sectional view taken along a line A-A of FIG. 5.
Figure 6B:
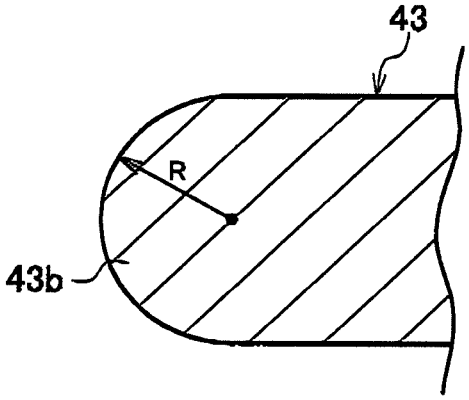
FIG. 6B is an enlarged cross-sectional view of an end in the short-side direction.
Figure 7A:
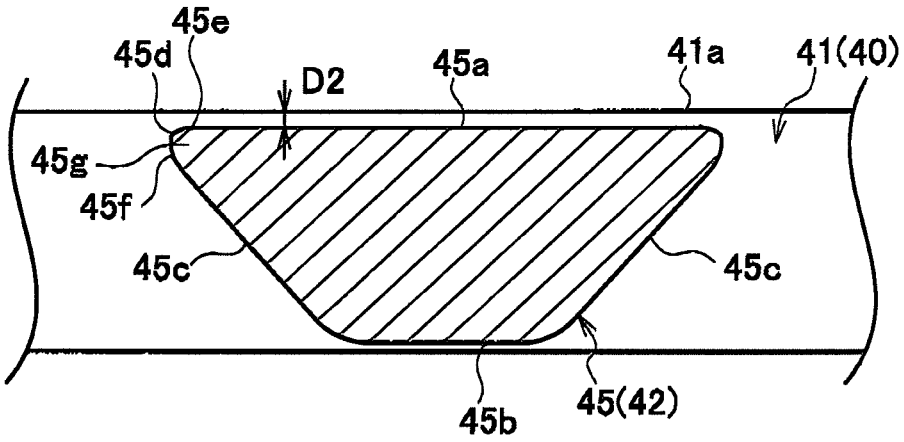
FIG. 7A is a cross-sectional view taken along a line B-B of FIG. 5.
Figure 7B:
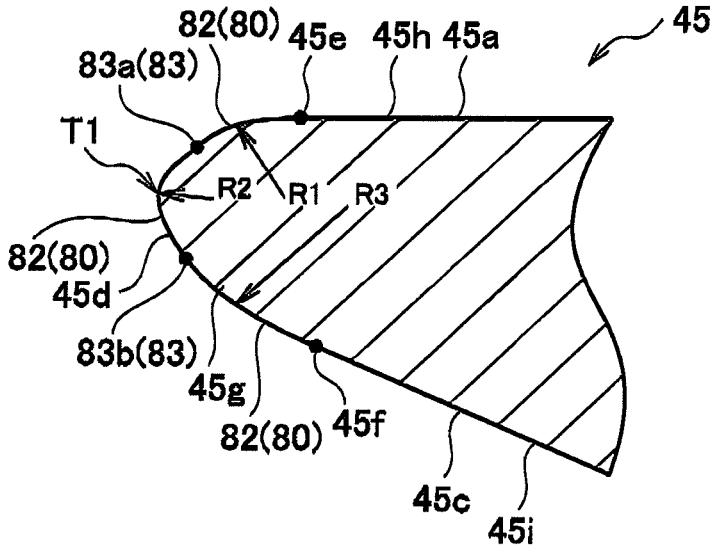
FIG. 7B is an enlarged cross-sectional view of a hair raising portion.

In this embodiment, the longitudinal bars 42 include: longitudinal bars 43 each having a cross-sectional shape shown in FIG. 6; and longitudinal bars (hair raising bars) 45 each having a cross-sectional shape shown in FIG. 7A.

In the top sections 9*a*, 10*a*, and 12*a*, the longitudinal bars 43 are arranged, and in the outside portions 9*b*, 10*b*, and 12*b*, the longitudinal bars 45 are arranged.

As shown in FIGS. 6A and 68, each longitudinal bar 43 is formed to have a substantially plate-shaped cross section. At the ends of the longitudinal bar 43 in the short-side direction, hair raising portions 43*b* having a semicircular cross section with a curvature radius R are provided. The curvature radius R is preferably 10 μm, for example. Herein, a top surface 41*a* of each short-side bar 41 is closer to the skin than a top surface 43*a* of each longitudinal bar 43, and the vertical distance between the top surface 43*a* of the longitudinal bar 43 and the top surface 41*a* of the short-side bar 41 set to D1.

As shown in FIG. 7A, each of the longitudinal bars (hair raising bars) 45 includes: a substantially flat skin contact surface 45*a* which is formed on the skin 70 side (on the upper side of FIG. 7A) so as to face the skin 70 and comes into contact with the skin 70; a flat bottom surface 45*b* formed on the inner blade 13 side (on the lower side of FIG. 7A); and inclined surfaces 45*c*, 45*c* (inner side surfaces facing the blade holes 50 or the inner blades 13) so as to go up toward both ends in the short-side direction.

At both ends of upper part of the bar 45 in the short-side direction, a pair of hair raising portions 45*g*, 45*g* are formed.

The hair raising portions 45*g*, 45*g* include a hair raising operation to efficiently raise the body hair 71 at a small angle from the skin (flat lying body hair). The vertical distance between each hair raising portion 45*g* and the top surface 41*a* of each short-side bar 41 is set to D2. The raising portions 45*g* are arranged with an offset so as to satisfy a relation of D2<D1.

In this embodiment, each hair raising portion 45*g* includes hair raising surfaces 45*d* connecting the ends (Side edge of each blade hole 50) 45 of the skin contact surface 45*a* and the ends 45*f* of the inclined surfaces 45*c*, 45*c* (inner side surface facing the blade hole 50 or inner blade 13) in the short-side direction.

In each hair raising surface 45*d*, a top portion T1 protruding toward the blade hole 50 is positioned on the skin 70 side.

Herein, the profile shape of the cross section of each hair raising portion 45*g* in the short-side direction is formed by connecting the blade hole side edge 45*e* in a cross-sectional line 45*h* of the skin contact surface 45*a* and the blade hole side edge 45*f* in a cross-sectional line 45*i* of the inclined surface (the inner side surface facing the blade hole 50 or inner blade 13) 45*c* with a single linear connecting element 81*a* or a plurality of connecting elements 80. In this embodiment, each connecting element 80 is at least any one of a line segment 81 and an arc line 82.

Specifically, as shown in FIG. 73, the blade hole side edge 45*e* in the cross-sectional line 45*h* of the skin contact surface 45*a* and the blade hole side edge 45*f* in the cross-sectional line 45*i* of the inclined surface (the inner side surface facing the blade hole 50 or inner blades 13) 45*c* are connected using three arc lines 82 so that the profile shape of the hair raising surface 45*d* (the profile shape of the cross section of the hair raising portion 45*g*) is composed of a smooth curve.

At this time, the arc line 82 connected to the blade hole side edge 45*e* of the cross-sectional line 45*h* of the skin contact surface 45*h* (an arc line with R1) is convex toward the skin 70 side and positioned on the blade hole 50 side of the blade hole side edge 45*e*. Furthermore, in this embodiment, the arc line (the arc line with R1) 82 is connected to the blade hole side edge 45*e* so that the skin contact surface 45*a* extends in a direction of a tangent line of a virtual circle including the arc line (arc line with R1) 82 at the blade hole side edge 45*e*.

The arc line (arc line with R3) 82 is connected to the blade hole side edge 45*f* in the cross-sectional line 45*i* of the inclined surface (inner side surface facing the blade hole 50 or inner blade 13) 45*c* in a similar manner.

The arc line (arc line with R1) 82 and the arc line (arc line with R2) 82 are smoothly connected at a connecting point 83*a*, and the arc line (arc line with R2) 82 and the arc line (arc line with R3) 82 are smoothly connected at a connecting point 83*b*. Specifically, as for the arc lines (arc lines with R1 and R2) 82, the arc line (arc line with R1) 82 and the arc line (arc line with R2) 82 only need to be connected so that the tangent line of a virtual circle including the arc line (arc line with R1) at the connecting point 83*a* is substantially parallel to the tangent line of a virtual circle including the arc line (arc line with R2) at the connecting point 83*a*. The arc lines (arc lines with R1 and R2) 82 just need to be smoothly connected to each other, and the tangent lines of the two virtual circles at the connecting point 83*a* do not need to be substantially parallel. The same goes for the arc line (arc line with R2) 82 and the arc line (arc line with R3) 82.

If adjacent arc lines with the centers of curvature set at a same position are connected to each other, the two arc lines form a single arc line. Accordingly, in this embodiment, when the connecting elements 80 are the arc lines 82, the two arc lines 82 are connected with the position of the centers of curvature different from each other.

In this embodiment, the arc lines 82 have different curvature radii R1, R2, and R3. Accordingly, the centers of curvature thereof can be made different by just connecting the arc lines 82 convex to the outside of the hair raising portion 45*g*.

In this embodiment, the arc lines 82 connected to each other have different curvature radii. However, a plurality of the arc lines 82 having a same curvature radius may be used. In this case, the arc lines 82 may be connected in a state where between the arc lines 82 having a same curvature radius, the arc line 82 having a curvature radius different from the above same curvature is sandwiched. In order to connect arc lines 82 having a same curvature radius adjacent to each other, the arc lines 82 just need to be connected so as to be convex in different directions to form an S-shaped curve.

In this embodiment, the hair raising portion 45*g* is formed to narrow toward the tip and has a higher hair raising ability than that of the hair raising portion 43*b* of each longitudinal bar 43. In short, the hair raising portion 45*g* can raise the flat lying body hair 71 more efficiently than the hair raising portion 43*b* of each longitudinal bar 43.

The cross section of the hair raising portion 45*g* formed by connecting the blade hole side edge 45*e* in the cross-sectional line 45*h* of the skin contact surface 45*a* and the blade hole side edge 45*f* in the cross-sectional line 45*i* of the inclined surface 45*c* with one linear connecting element 81*a* or a plurality of connecting elements 80 can have various profile shapes.

Hereinafter, modifications of the profile shape of the cross section of the hair raising portion 45*g* according to the embodiment will be described.

First, shapes shown FIGS. 8A to 8C will be described.

Figure 8A:
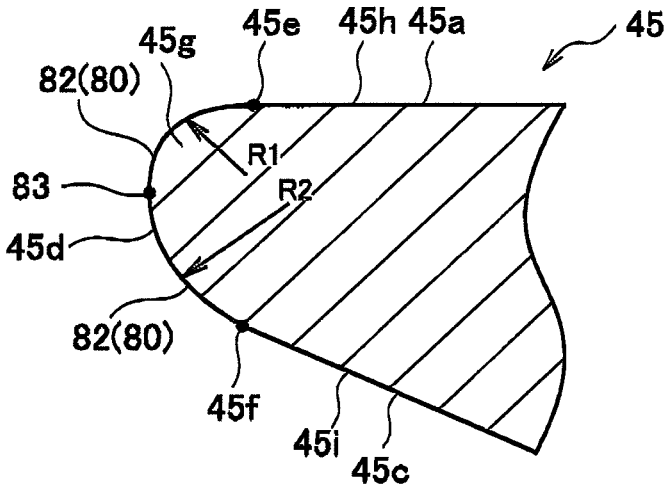
FIGS. 8A to 8C are enlarged cross-sectional views of a first modification of the hair raising portion according to the embodiment of the present invention.
Figure 8B:
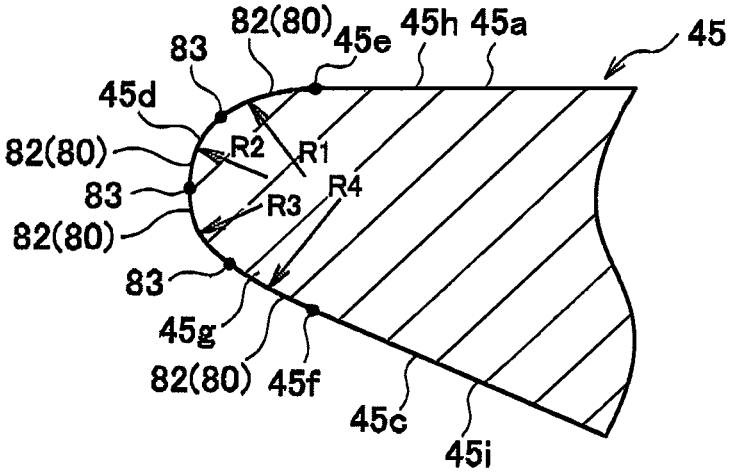
Figure 8C:
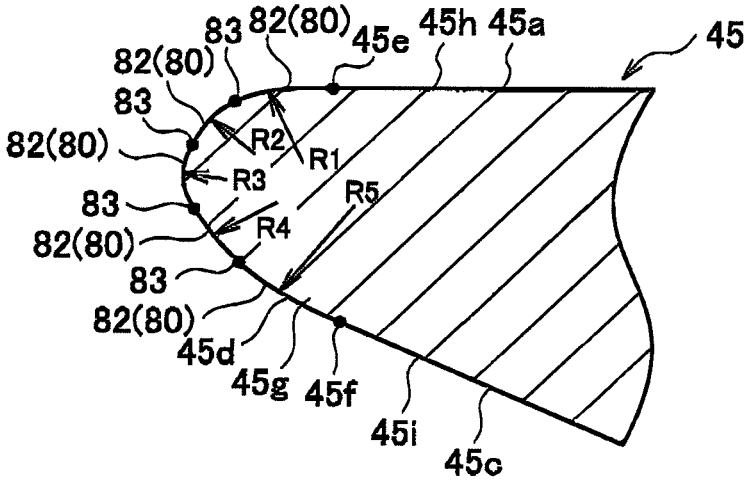

In each of FIGS. 8A to 8C, the profile shape of the cross section of the hair raising portion 45*g* includes a plurality of arc lines as the connecting elements 80 connected similar to the aforementioned embodiment. In short, the profile shape of the hair raising surface 45*d* is formed without using the line segment 81.

FIG. 8A shows a profile shape of the hair raising surface 45*d* including two arc lines 82, FIG. 8B shows a profile shape including four arc lines 82, and FIG. 8C shows an profile shape including five arc lines 82. The number of arc lines is not limited to these numbers. The profile shape of the hair raising surface 45*d* may be formed using six or more arc lines. In order to connect a plurality of arc lines 82 so that the profile shape is convex toward the outside of the hair raising portion 45*g*, the arc lines 82 adjacent to each other need to have different curvature radii and different positions of the centers of curvature. In each of FIGS. 8A to 8C, the curvature radii are sequentially indicated by curvature radii R1, R2, . . . starting from the blade hole side edge 45*e* of the skin contact surface 45*a*. The curvature radii R1 shown in FIGS. 8A to 8C do not indicate a same curvature radius. The same goes for the curvature radii R1, R2, . . . and angles of the corners L1, L2 . . . in FIGS. 9A to 9C or other drawings.

Figure 9A:
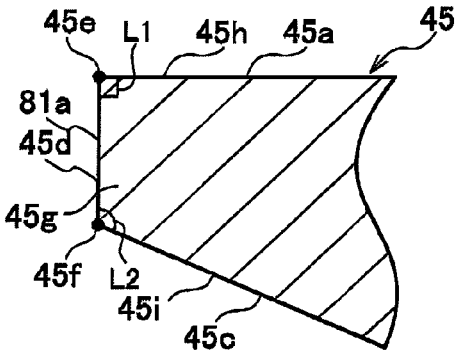
FIGS. 9A to 9E are enlarged cross-sectional views of a second modification of the hair raising portion according to the embodiment of the present invention.
Figure 9B:
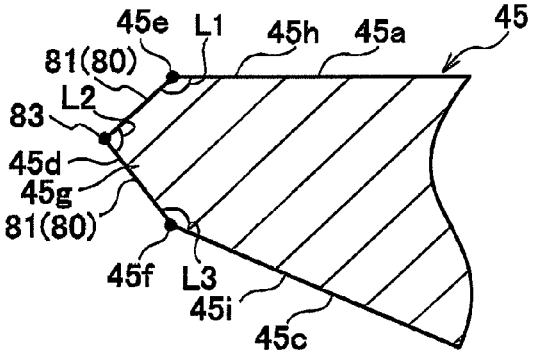
Figure 9C:
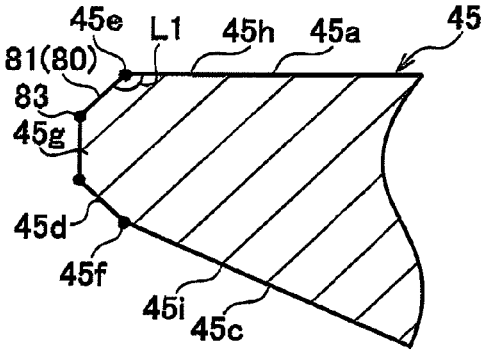

Next, shapes shown in FIGS. 9A to 9C are described.

First, FIG. 9A shows an profile shape of the cross-section of the hair raising portion 45*g* which is formed by connecting the blade hole side edge 45*e* in the cross-sectional line 45*h* of the skin contact surface 45*a* and the blade hole side edge 45*f* in the cross-sectional line 45*i* of the inclined surface 45*c* (the inner side surface facing the blade hole 50 or inner blade 13) with a single line connecting element 81*a*. In FIG. 9A, the linear connecting element 81*a* and the cross-sectional line 45*h* of the skin contact surface 45*h* are connected so that the angle between the linear connecting element 81*a* and the cross-sectional line 45*h* of the skin contact surface 45*h* is a right angle (not less than 90 degrees but less than 180 degrees).

Furthermore, the linear connecting element 81*a* and the cross-sectional line 45*i* of the inclined surface 45*c* (the inner side surface facing the blade hole 50 or inner blade 13) are connected so that the angle between the linear connecting element 81*a* and the cross-sectional line 45*h* of the skin contact surface 45*h* is not less than 90 degrees but less than 180 degrees.

By connecting the blade hole side edge 45*e* in the cross-sectional line 45*h* of the skin contact surface 45*a* and the blade hole side edge 45*f* in the cross-sectional line 45*i* of the inclined surface 45*c* with the single line connecting element 81*a* in such a manner, each of two corners L1 and L2 which is a right or obtuse angle are formed at the ends of the longitudinal bar (hair raising bar) 45 in the short-side direction.

As shown in FIG. 9A, if the angle between the linear connecting element 81*a* and the cross-sectional line 45*d* of the skin contact surface 45*a* is set to a right angle, the hair raising surface 45 is composed of a vertical surface. The vertical surface can support the body hair 71, and the body hair 71 can be therefore more reliably raised (see FIG. 11). Moreover, by setting the corner L1 to not an acute angle, the influence of the hair raising portion 45*g* on the skin 70 can be reduced.

Each of FIGS. 9B to 9E shows a profile shape of the cross section of the hair raising portion 45*g* which is formed by connecting a plurality of line segments 81 as the connecting elements 80.

Figure 9D:
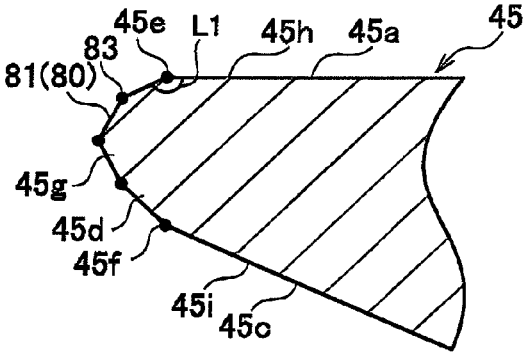
Figure 9E:
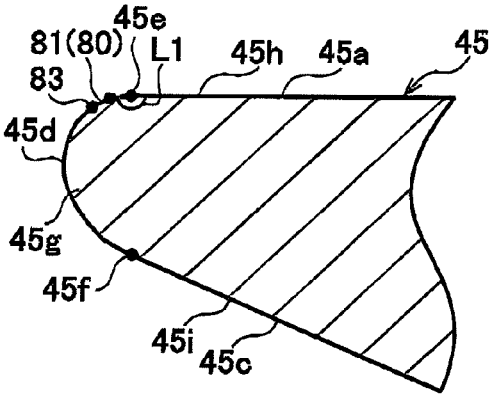

FIG. 9B shows an profile shape of the cross section including three corners L1 to L3 formed by using two line segments 81. FIG. 9C shows an profile shape including four corners L1 to L4 formed by using three line segments 81. FIG. 9D shows an profile shape including five corners L1 to L5 formed by using four line segments 81. FIG. 9E shows an profile shape including six or more corners formed by using five or more line segments 81.

Herein, in order to connect two line segments of the linear connecting elements 81*a*, the cross-sectional line 45*h* of the skin contact surface 45*a*, and the cross-sectional line 45*i* of the inclined surface (the inner side surface 13 facing the blade hole 50 or inner blades 13), as described above, it is preferable that the two line segments are connected so that the angle therebetween is not less than 90 degrees but less than 180 degrees. This can reduce the influence of the hair raising portion 45*g* on the skin 70 since there is no acute angle formed in the profile shape of the cross-section of the hair raising portion 45*g*.

As described above, FIGS. 9A to 9E, including FIG. 9A, show profile shapes of the hair raising portion 45*g* without using an arc line 82.

Next, shapes shown in FIGS. 10A to 10D are described.

Each of FIGS. 10A to 10D shows an profile shape of the cross section of the hair raising portion 45*g* which is formed by connecting the blade hole side edge 45*e* in the cross-sectional line 45*h* of the skin contact surface 45*a* and the blade hole side edge 45*f* in the cross-sectional line 45*i* of the inclined surface 45*c* with a line segment 81 and arc lines 82 (a plurality of connecting elements 80).

Specifically, in FIGS. 10A to 10D, the blade hole side edge 45*e* in the cross-sectional line 45*h* of the skin contact surface 45*a* and the blade hole side edge 45*f* in the cross-sectional line 45*i* of the inclined surface 45*c* are connected to the arc lines 82. Moreover, the arc lines 82 and the line segments 81 are alternately connected between the blade hole side edge 45*e* in the cross-sectional line 45*h* of the skin contact surface 45*a* and the blade hole side edge 45*f* in the cross-sectional line 45*i* of the inclined surface 45*c* so that the profile shape of the cross section of the hair raising portion 45*g* does not include a corner which could be formed by connecting line segments.

The segment lines 81 and the arc lines 82 are connected in the same way as the above-described connecting method.

Figure 10A:
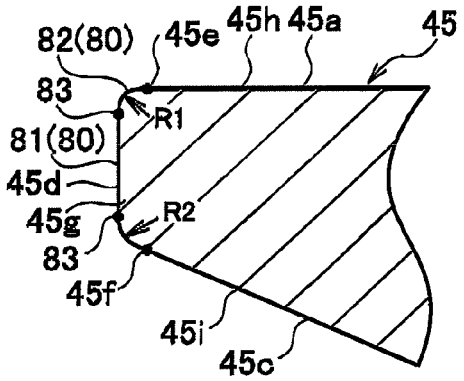
FIGS. 10A to 10D are enlarged cross-sectional views of a third modification of the hair raising portion according to the embodiment of the present invention.
Figure 10B:
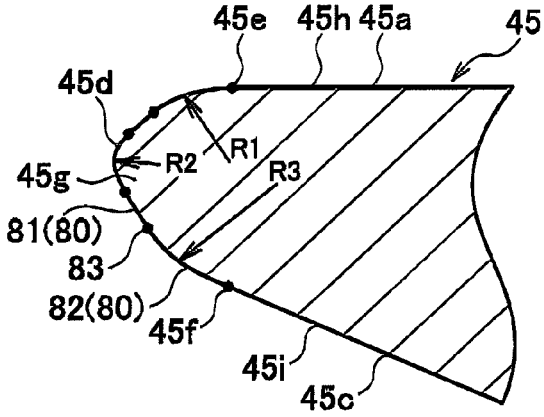
Figure 10C:
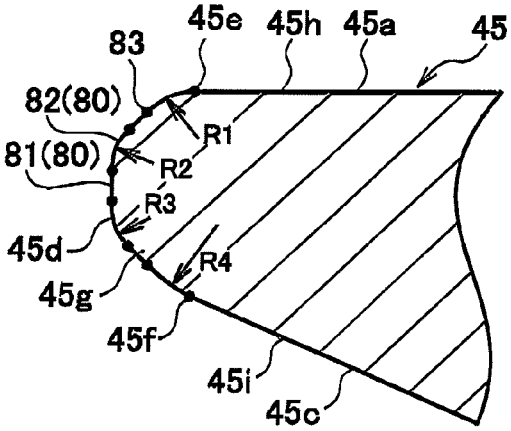
Figure 10D:
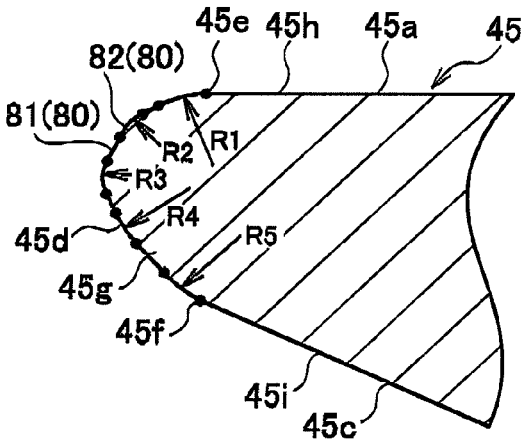

FIG. 10A shows an profile shape including two arc lines 82. FIG. 10E shows an profile shape including three arc lines 82. FIG. 10D shows an profile shape including four arc lines 82. FIG. 10E shows an profile shape including five arc lines 82. The number of line segments used at this time is n−1 when the number of arc lines 82 is n.

Figure 11:
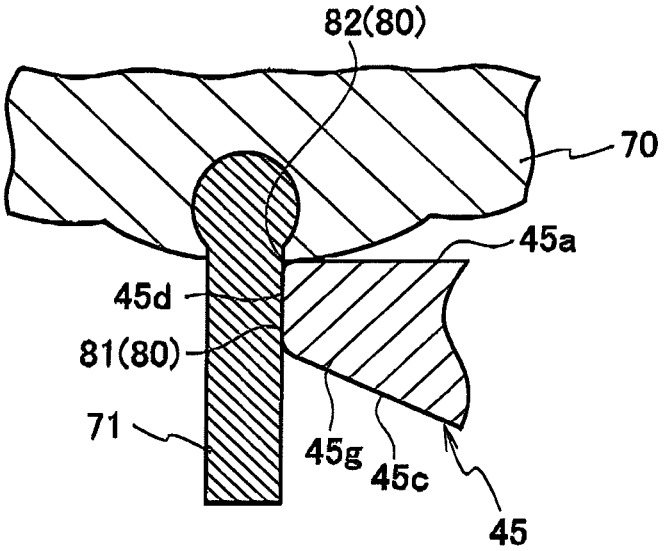
FIG. 11 is a cross-sectional view schematically illustrating a state where the hair raising bar of FIG. 10A is raising flat lying body hair.
Figure 12A:
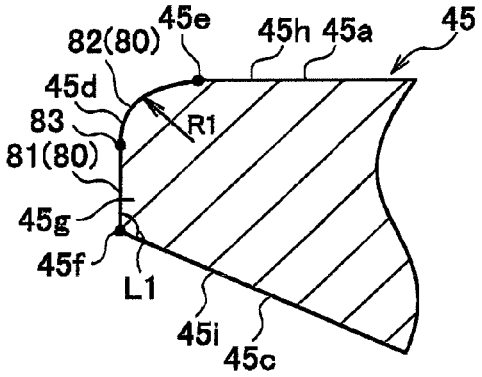
FIGS. 12A to 12F are enlarged cross-sectional views of a fourth modification of the hair raising portion according to the embodiment of the present invention.
Figure 12B:
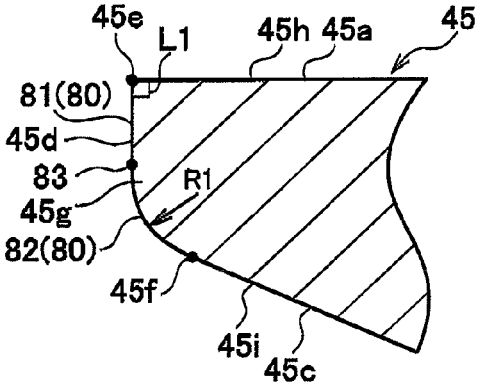
Figure 12C:
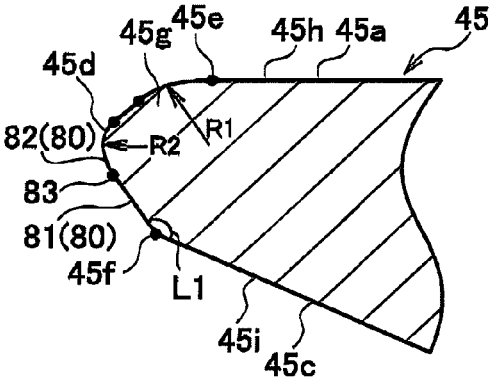
Figure 12D:
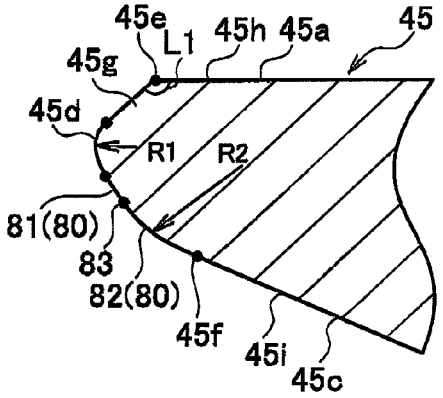
Figure 12E:
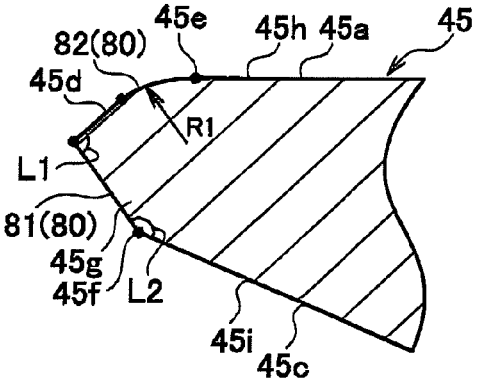
Figure 12F:
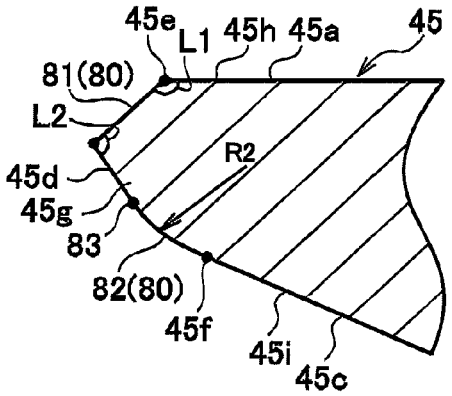
Figure 13A:
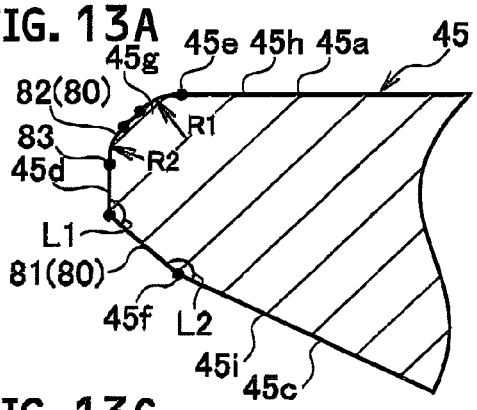
FIGS. 13A to 13G are enlarged cross-sectional views of a fourth modification of the hair raising portion according to the embodiment of the present invention.
Figure 13B:
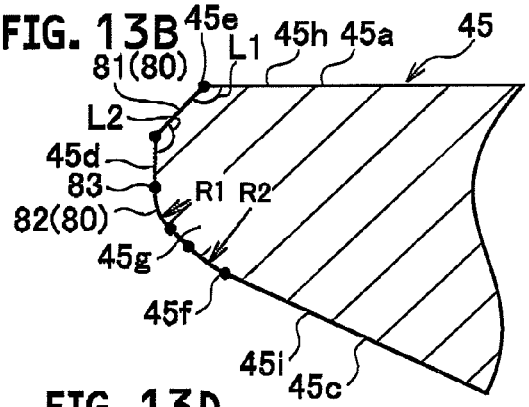
Figure 13C:
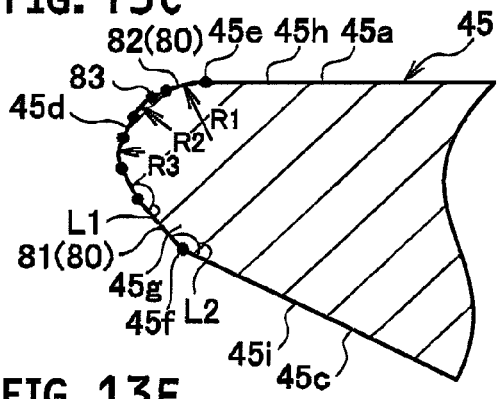
Figure 13D:
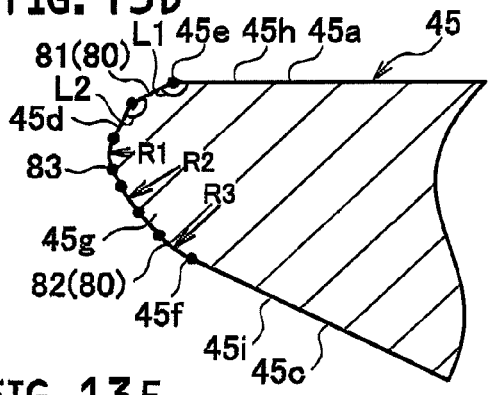
Figure 13E:
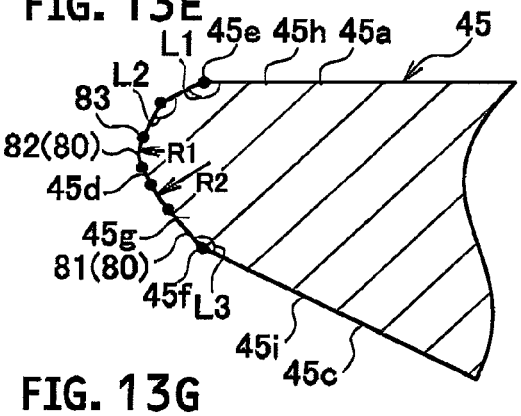
Figure 13F:
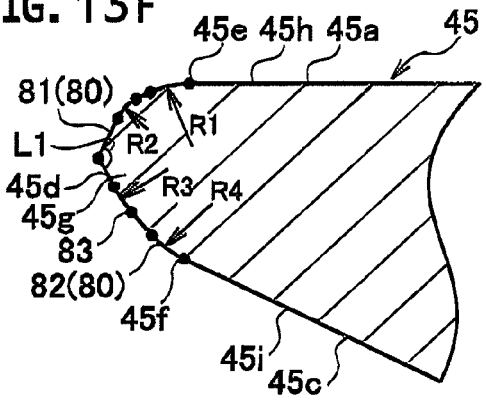
Figure 13G:
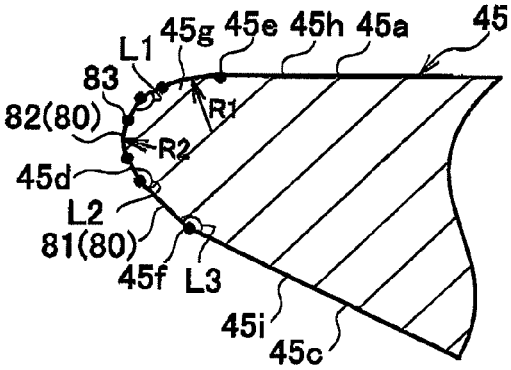

As shown in FIG. 10A, if one line segment 81 and two arc lines 82 are used to form a vertical surface, no corner L is formed. Accordingly, as shown in FIG. 11, it is possible to reliably raise the body hair 71 while further reducing the influence of the hair raising portion 45*g* on the skin 70.

Next, shapes shown in FIGS. 12A to 12F and FIGS. 13A to 13G will be described.

Each of FIGS. 12A to 12F and FIGS. 13A to 13G shows a profile shape of the cross section of the hair raising portion 45*g* which is formed by connecting the blade hole side edge 45*e* in the cross-sectional line 45*h* of the skin contact surface 45*a* and the blade hole side edge 45*f* in the cross-sectional line 45*i* of the inclined surface 45*c* with a line segment 81 and an arc line 82 (a plurality of connecting elements 80).

Specifically, in each of FIGS. 12A to 12F and FIGS. 13A to 13G, the profile shape of the cross section of the hair raising portion 45*g* differs from those shown in FIGS. 10A to 10D in that line segments 81 are connected to form a corner L.

FIGS. 12A to 12F and FIGS. 13A to 13G show profile shapes with arc lines 82 provided on the skin 70 side, profile shapes with arc lines 82 provided on the inner blade 13 side, and profile shapes with arc lines 82 provided substantially at the center.

The connection between the arc lines 82, the connection between the line segments 81, and the connection between the arc line 82 and the line segment 81 are performed in the same method as the aforementioned connection method.

Figure 14A:
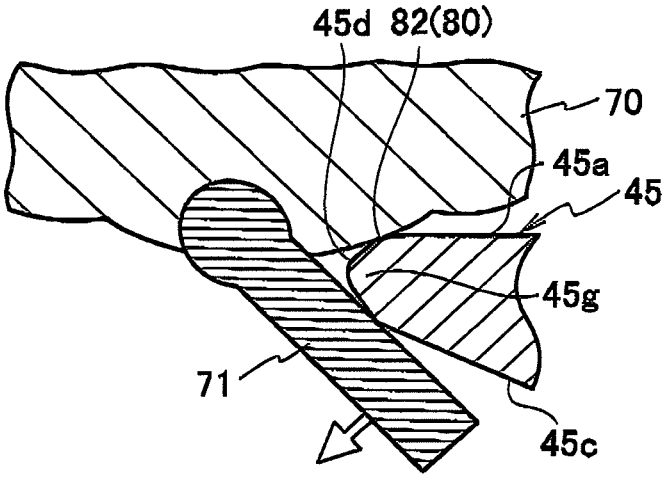
FIGS. 14A and 14B are views schematically showing a process where the hair raising portion is raising flat lying body hair, FIG. 14A being a cross-sectional view schematically showing a state where the hair raising portion of FIG. 12C is raising flat lying body hair, FIG. 14B being a cross-sectional view schematically showing a state where the hair raising portion of FIG. 12F is raising flat lying body hair.

By providing the arc lines 82 on the skin 70 side in the profile shape of the cross section of the hair raising portion 45*g*, as shown in FIG. 14A, the profile of the cross section of the hair raising portion 45*g* on the skin 70 side is made smooth. Accordingly, the influence of the hair raising portion 45*g* on the skin 70 can be reduced.

Figure 14B:
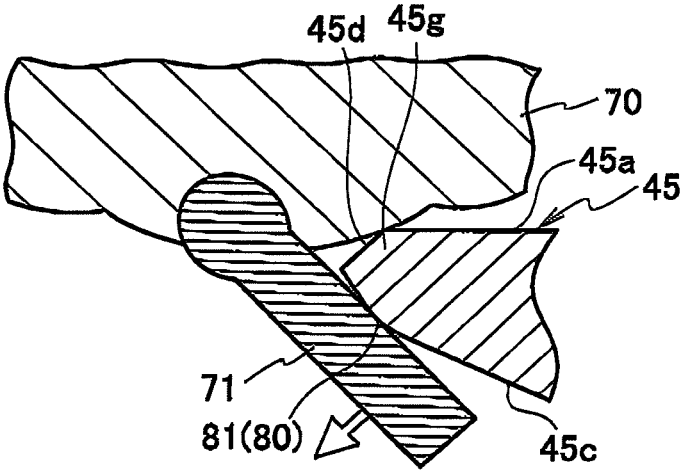

When the cross section of the hair raising portion 45*g* has an profile shape with the arc line 82 provided on the inner blade 13 side, as shown in FIG. 14B, the portion coming into contact with the body hair 71 has a smooth profile. The body hair 71 can be therefore raised more smoothly.

Next, shapes shown in FIGS. 15A to 15C will be described.

Figure 15A:
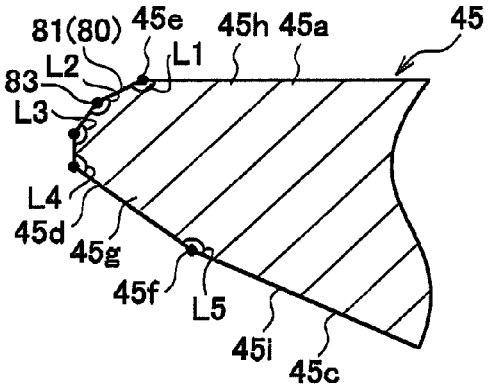
FIGS. 15A to 15*c* are enlarged cross-sectional views of a fifth modification of the hair raising portion according to the embodiment of the present invention.
Figure 15B:
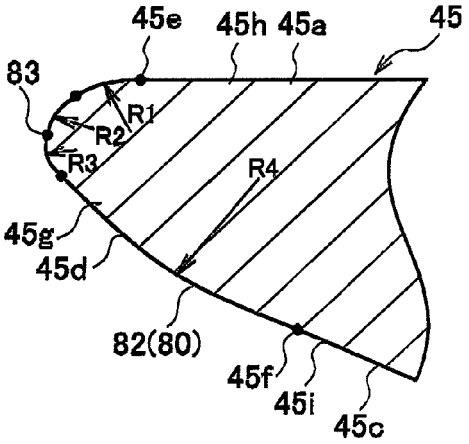
Figure 15C:
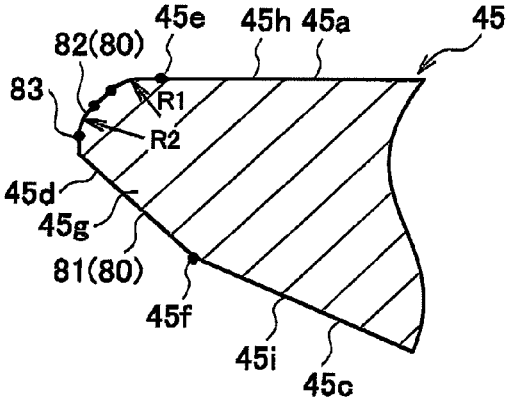

Each of FIGS. 15A to 15C shows an profile shape of the cross section of the hair raising portion 45*g* in which the connecting elements 80 provided on the skin 70 side (the length of a line segment 81 or the length of a straight line connecting the connecting points 83 at both ends of an arc line 82) are shorter than the connecting elements 80 provided on the inner blade 13 side.

In the other words, in the profile shape of the cross section of the hair raising portion 45*g*, the distances between adjacent connecting points 83 (including the blade hole side edge 45*e*) on the skin 70 side are shorter than the distances between adjacent connecting points 83 (including the blade hole side edge 45*f*) on the inner blade 13 side.

The profile shape can be formed by using only the line segments 81 (see FIG. 15A), using only the arc lines (see FIG. 153), or using both the line segments and arc lines (see FIG. 15C).

Figure 16:
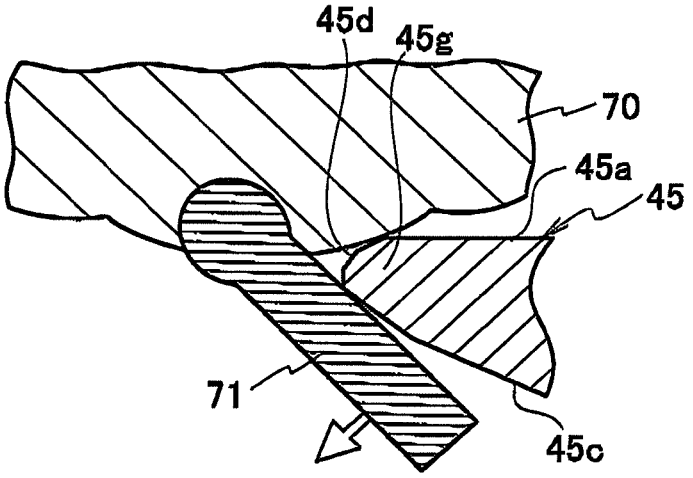
FIG. 16 is a cross-sectional view schematically showing a state where the hair raising portion of FIG. 15A is raising flat lying body hair.

By setting the distances between adjacent connecting points 83 on the skin 70 side shorter than the distances between adjacent connecting points 83 on the inner blade 13 side, the profile on the skin 70 side can be smoothly curved, and the influence of the hair raising portion 45*g* on the skin 70 can be reduced as shown in FIG. 16.

Moreover, by setting the distances between adjacent connecting points 83 on the inner blade 13 side longer, formation of the profile shape on the inner blade 13 side is facilitated.

Next, shapes shown in FIGS. 17A to 17C will be described.

Figure 17A:
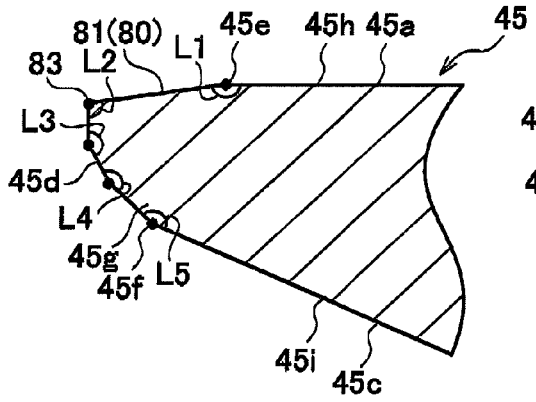
FIGS. 17A to 17C are enlarged cross-sectional views of a sixth modification of the hair raising portion according to the embodiment of the present invention.
Figure 17B:
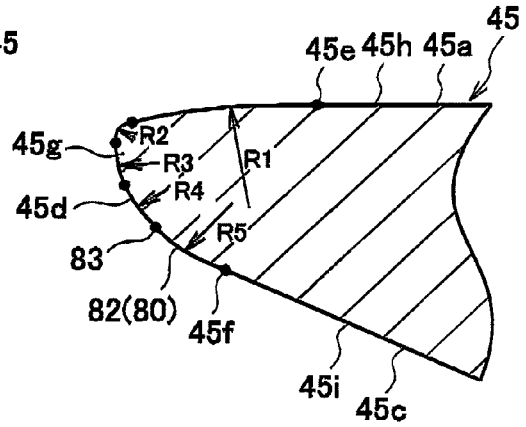
Figure 17C:
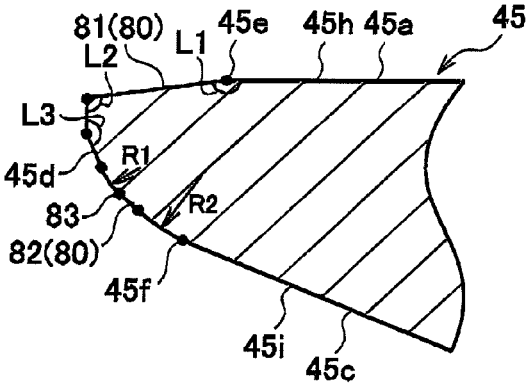
Figure 18:
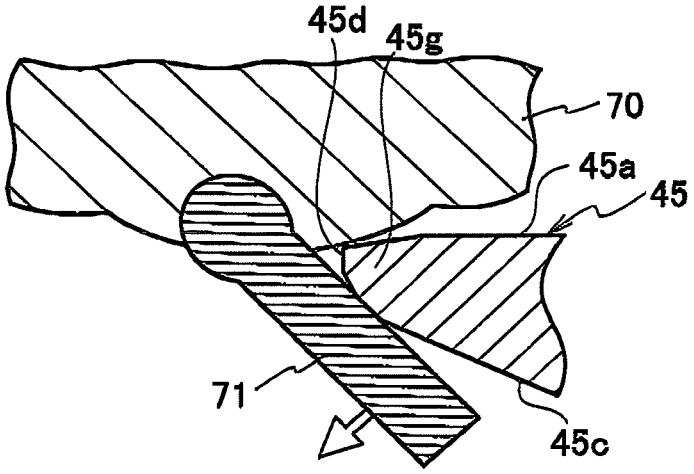
FIG. 18 is a cross-sectional view schematically showing a state where the hair raising portion of FIG. 17A is raising flat lying body hair.

Each of FIGS. 17A to 17C shows an profile shape of the cross section of the hair raising portion 45*g* in which the connecting elements 80 provided on the skin 70 side (the length of a line segment 81 or the length of a straight line connecting the connecting points 83 at both ends of an arc line 82) are longer than the connecting elements 80 provided on the inner blade 13 side.

In other words, in the profile shape of the cross section of the hair raising portion 45*g*, the distances between adjacent connecting points 83 on the skin 70 side are set longer than the distances between adjacent connecting points 83 on the inner blade 13 side.

The profile shape can be formed by using only the line segments 81 (see FIG. 17A), using only the arc lines (see FIG. 17B), or using both the line segments and arc lines (see FIG. 17C).

By setting the distances between adjacent connecting points 83 on the skin 70 side longer than the distances between adjacent connecting points 83 on the inner blade 13 side, the portion coming into contact with the skin 70 has a smooth profile. Accordingly, the body hair 71 can be more smoothly raised.

Moreover, by setting the distances between adjacent connecting points 83 on the skin 70 side longer, formation of the profile shape on the skin 70 side is facilitated.

Next, the shapes shown in FIG. 19 will be described.

Figure 19:
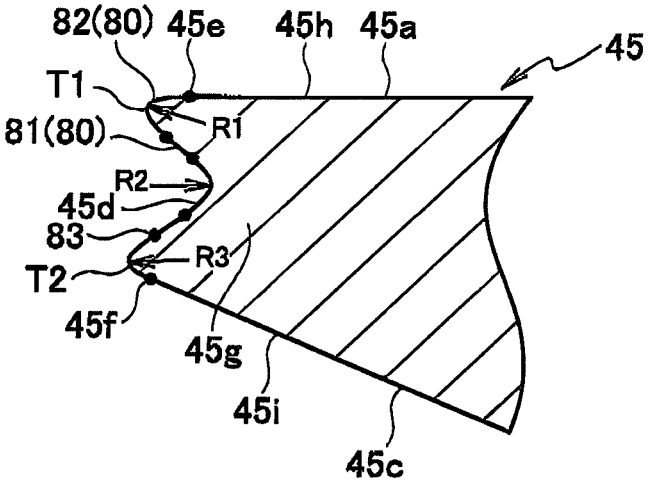
FIG. 19 is an enlarged cross-sectional view of a seventh modification of the hair raising portion according to the embodiment of the present invention.

FIG. 19 shows an profile shape of the cross-section of the hair raising portion 45*g* including a top portion T1 in the skin 70 side of the hair raising portion 45*d* and a second top portion T2 on the inner blade 13 side of the top portion T1. The profile shape may include three or more top portions.

In FIG. 19, two line segments 81 and three arc lines 82 are use to form the top portion T1 and second top portion T2. At this time, the line segments 81 and arc lines 82 are alternately connected so that the profile shape of the cross section of the hair raising portion 45*g* includes no corner which could be formed by connecting line segments.

Specifically, an arc line (arc line with R1) 82 and an arc line (arc line with R3) 82 are connected to the blade hole side edge 45*e* in the cross-sectional line 45*h* of the skin contact surface 45*a* and the blade hole side edge 45*f* in the cross-sectional line 45*i* of the inclined surface 45*c*, respectively, so as to be convex toward the outside of the hair raising portion 45*g*. The arc line (arc line with R1) 82 and an arc line (arc line with R3) 82 are individually connected to line segments 81, and the line segments 81 are connected to an arc line (arc line with R2) 82 so that the arc line 82 is convex toward the inside of the hair raising portion 45*g*, thus forming the top portion T1 and second top portion T2.

Figure 20A:
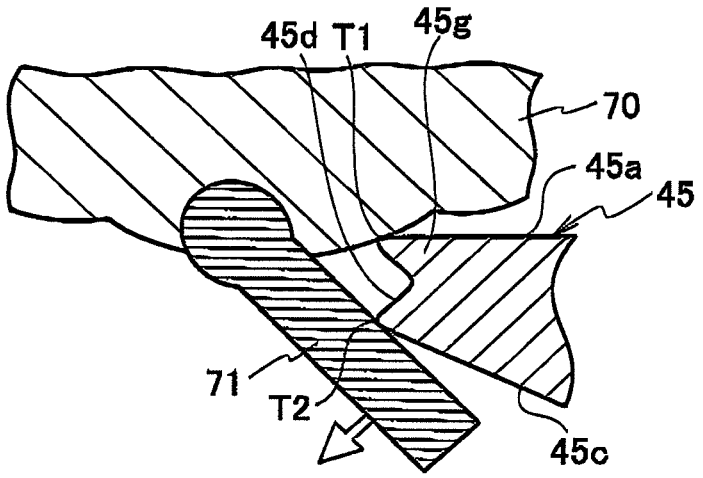
FIGS. 20A and 20B are views schematically showing a process where the hair raising portion of FIG. 19 is raising flat lying body hair, FIG. 20A being a cross-sectional view schematically showing a state where the hair raising portion is under flat lying body hair, FIG. 20B being a cross-sectional view schematically showing a state where the hair raising portion has raised the flat lying body hair.
Figure 20B:
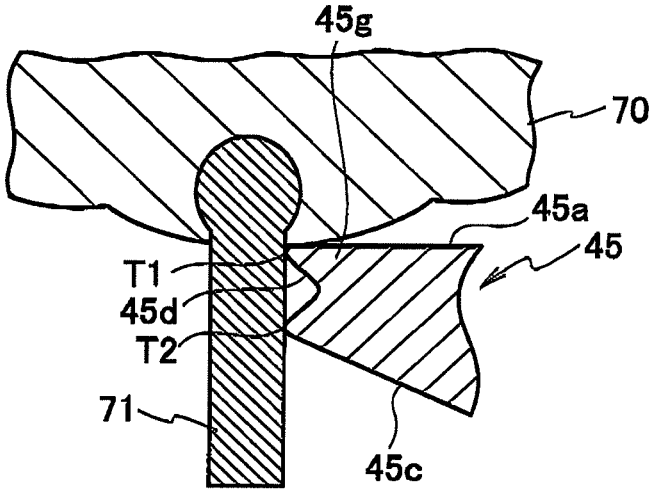

By providing the top portions T1 in the skin 70 side of the hair raising surface 45*d* and the second top portion T2 on the inner blade 13 side of the top portion T1 in the profile shape of the cross section of the hair raising portion 45*g* in such a manner, as shown in FIG. 20A, the area of contact with the body hair 71 can be made small, and the body hair 71 can be therefore raised more smoothly.

Moreover, since the hair raising portion 45*g* includes the top portion T1 and the second top portion T2, the body hair 71 can be supported by the two top portions T1 and T2, and the hair raising effect can be further increased.

As described above, in this embodiment, the profile shape of the cross section of the hair raising portion 45*g* is composed of the connecting elements 80 connected to each other, each connecting element 80 being at least any one of the line segment 81 and arc line 82. Accordingly, the shape of the hair raising portion 45*g* can be a shape capable of reducing the influence on the skin 70 while increasing the hair raising effect. According to the embodiment, the influence on the skin 70 can be reduced while the performance of introducing the flat lying body hair 71 to the outer blades 8 can be increased.

Moreover, in this embodiment, the cross section of the hair raising portion 45*g* has a profile shape including the arc line 82 positioned on the skin 70 side. By providing the arc line 82 placed on the skin 70 side in the cross section of the hair raising portion 45*g*, the hair raising portion 45*g* in the skin 70 side has a smooth profile, and the influence of the hair raising portion 45*g* on the skin 70 can be therefore reduced.

Furthermore, in this embodiment, the cross section of the hair raising portion 45*g* has an profile shape including the arc line 82 positioned on the inner blade 13 side. By providing the arc line 82 positioned on the inner blade 13 side in the cross section of the hair raising portion 45*g*, the portion coming into contact with the body hair 71 has a smooth profile, and the body hair 71 can be raised more smoothly.

In this embodiment, still furthermore, the cross section of the hair raising portion 45*g* has a profile shape in which the distances between the connecting points 83 of the connecting elements 80 on the skin 70 side are longer than the distances between the connecting points 83 of the connecting elements 80 on the inner blade 13 side. By setting the distances between the adjacent connecting points 83 on the skin 70 side longer than the distances between the adjacent connecting points 83 on the inner blade 13 side, the profile on the inner blade 13 can be smoothly curved, and the portion coming into contact with the body hair 71 has a smooth profile. Accordingly, the body hair 71 can be raised more smoothly.

In this embodiment, still furthermore, the cross section of the hair raising portion 45*g* has an profile shape in which the distances between the connecting points 83 of the connecting elements 80 on the skin 70 side are shorter than the distances between the connecting points 83 of the connecting elements 80 on the inner blade 13 side. By setting the distances between the adjacent connecting points 83 on the skin 70 side shorter than the distances between the adjacent connecting points 83 on the inner blade 13 side, the profile on the skin 70 can be smoothly curved. The influence of the hair raising portion 45*g* on the skin 70 can be therefore reduced.

In this embodiment, still furthermore, the top portion T1 is formed in the skin 70 side of the hair raising surface 45*d*. By forming the top portion T1 in the skin 70 side of the hair raising surface 45*d* in such a manner, the flat lying body hair 71 can be raised more efficiently.

In this embodiment, still furthermore, the second top portion T2 is formed on the inner blade 13 side of the top portion T1. By forming the second top portion T2 on the inner blade 13 side of the top portion T1 in such a manner, the area of contact with the body hair 71 can be made small. The body hair 71 can be therefore raised more smoothly.

Still furthermore, by including the top portion T1 and second top portion T2, or by including a plurality of top portions, the body hair 71 can be supported by the plurality of top portions, and the hair raising effect can be further increased.

According to this embodiment, in the part of each of the net blades 9, 10, and 12 with high contact pressure against the skin 70 (the top sections 9*a*, 10*a*, and 12*a*), the longitudinal bars (first bars) 43 are placed. In the part with low contact pressure against the skin 70 (the outside sections 9*b*, 10*b*, and 12*b*), the longitudinal bars (hair raising bars) 45 each including the hair raising portions 45*g* with higher hair raising ability than that of the hair raising portions 43*b* of the longitudinal bars 43 are placed.

By setting the hair raising ability of the part with high contact pressure against the skin 70 lower than that of the part with low contact pressure, it is possible to reduce the influence (damage) of the part with high contact pressure against the skin 70 on the skin 70.

Since the part with low contact pressure against the skin 70 originally have less influence on the skin 70, the hair raising ability can be increased so as to efficiently raise hair.

According to this embodiment, the bars 40 include the longitudinal bars 42 extending in the longitudinal direction of the net blades (outer blades) 9, 10, and 12 and the short-side bars 41 extending in the short-side direction intersecting the longitudinal direction, thus forming the net blades (outer blades) 9, 10, and 12 into mesh. This allows the body hair 71 to be easily inserted into the blade holes 50, thus providing an effect of facilitating shaving the body hair 71.

According to this embodiment, each of the net blades (outer blades) 9, 10, and 12 is curved in an inverted U-shape in a side view. The side surfaces (hair raising portions) 43*b* are formed at both ends of the longitudinal bars 43 in the short-side direction in the net blades (outer blades) 9, 10, and 12. The hair raising portions 45*g* are formed at both ends of the longitudinal bars 45 in the short-side direction in the net blades (outer blades) 9, 10, and 12. The body hair 71 can be therefore raised whichever the electric shaver 1 is moved in the short-side direction forward or backward. This can provide an effect of improving the usability.

Next, modifications of the bars according to this embodiment will be described.

(First Modification)

Figure 21A:
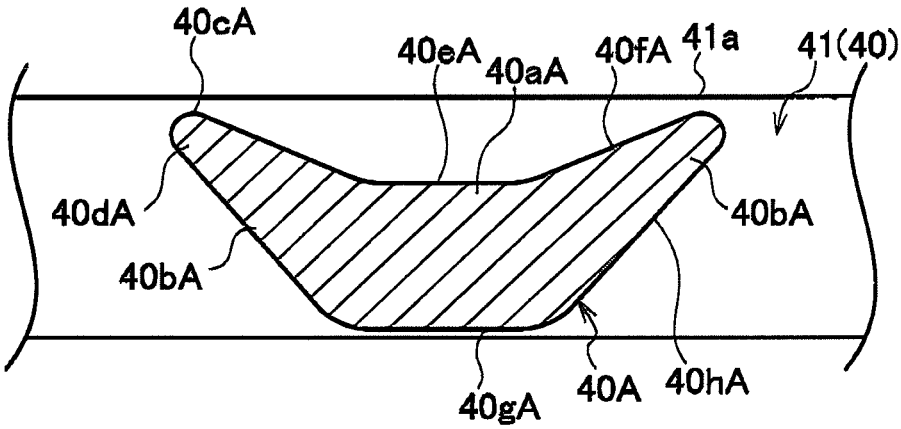
FIGS. 21A and 21B are views showing a bar according to a first modification of the embodiment of the present invention, FIG. 21A being a cross-sectional view of the bar, FIG. 21B being an enlarged cross-sectional view of the hair raising portion.

As shown in FIG. 21A, a bar 40A according to this modification has a substantially V shaped cross section.

Specifically, the bar 40A includes a substantially plate-shaped plate portion 40*a*A at the center in the short-side direction. At both ends of the plate portion 40*a*A in the short-side direction, inclined portions 40*b*A which are inclined so as to go up starting from the plate portion 40*a*A side toward the both ends in the short-side direction are provided. The inclined portions 40*b*A are tapered to narrow starting from the plate portion 40*a*A side to the both ends in the short-side direction. At an end 40*c*A of each inclined portion 40*b*A in the short-side direction, a hair raising portion 40*d*A raising the body hair is formed.

The bar 40A is defined by an upper flat surface 40A of the plate portion 40*a*A, an upper inclined surface 40*f*A of the inclined portion 40*b*A, a bottom surface 40*g*A of the plate portion 40*a*A, and a lower inclined surface 40*h*A of the inclined portion 40*b*A.

In this embodiment, the upper flat surface 40*e*A and upper inclined surface 40*f*A correspond to the skin contact surface coming into the skin 70, and the lower inclined surface 40*h*A corresponds to the inner side surface facing the blade hole 50 or inner blade 13.

Figure 21B:
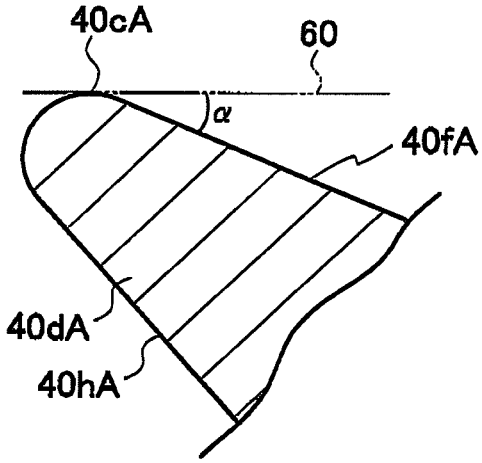

As shown in FIG. 21B, a clearance angle $\alpha$ between the short-side reference line 60 indicated by a two-dot chain line and the upper inclined surface 40*f*A is set larger than a clearance angle (0°) between the top surface 43*a* of each longitudinal bar 43 and the short-side direction reference line 60 as shown in FIG. 6A described above. By setting the clearance angle in the part with high contact pressure against the skin 70 smaller than the clearance angle $\alpha$ in the part with low contact pressure against the skin 70 in such a manner, it is possible to reduce the influence (damage) of the part with high contact pressure against the skin 70 on the skin 70.

If the bar 40A of such a shape is used and the cross section of the hair raising portion 40*d*A in the bar 40A has a profile shape shown in the embodiment or each modification, it is possible to provide the same operation and effects as those of the aforementioned embodiment.

(Second Modification)

Figure 22:
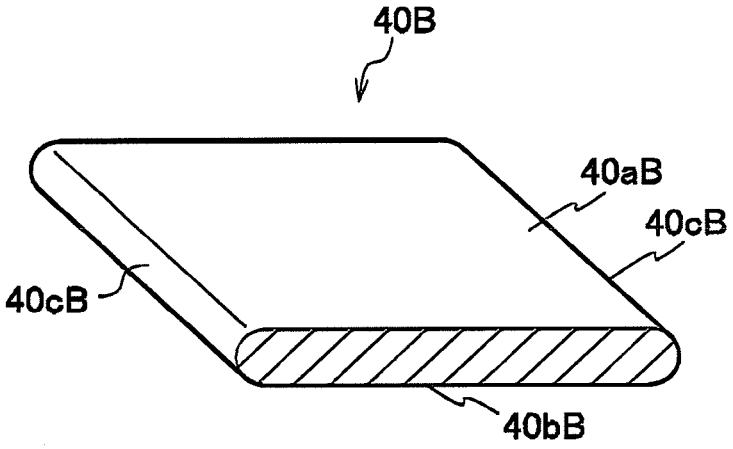
FIG. 22 is a cross-sectional view showing a bar according to a second modification of the embodiment of the present invention.

As shown in FIG. 22, a bar 405 according to this modification is formed into a plate shape including: a substantially flat skin contact surface 40*a*5 which is formed on the skin 70 side (on the upper side in FIG. 22) and comes into contact with the skin 70; and a flat bottom surface (the inner side surface facing the blade hole 50 or inner blade 13) 40*b*B formed on the inner blade 13 side (on the lower side in FIG. 16). The both ends of the bar 40B in the short-side direction constitute semicircular hair raising portions 40*c*B and 40*c*B.

If the bar 40B of such a shape is used and the cross section of the hair raising portion 40*c*B in the bar 40B has a profile shape shown in the embodiment or each modification, it is possible to provide the same operation and effects as those of the aforementioned embodiment.

(Third Modification)

Figure 23:
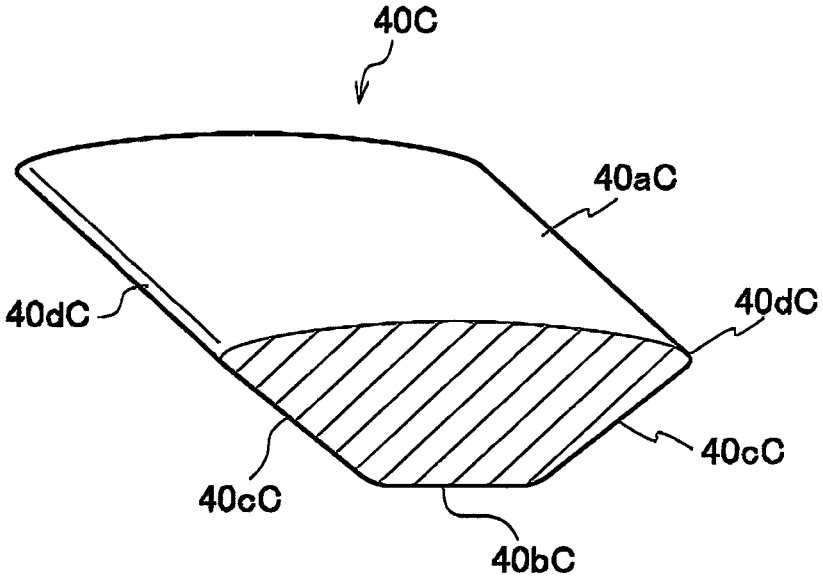
FIG. 23 is a cross-sectional view showing a bar according to a third modification of the embodiment of the present invention.

As shown in FIG. 23, a bar 40C according to this modification includes: a skin contact surface 40*a*C which is curved convexly toward the skin 70 side (on the upper side in FIG. 23) and comes into contact with the skin 70; a flat bottom surface 40*b*C formed on the inner blade 13 side (on the lower side in FIG. 23); and both side surfaces (the inner side surfaces facing the blade hole 50 or inner blade 13) 40*c*C, 40*c*C formed at the ends in short-side direction. At the both ends of upper part of the bar 40C, a pair of hair raising portions 40*d*C, 40*d*C are formed.

If the bar 40C of such a shape is used and the cross section of the hair raising portion 40*c*C in the bar 40C has a profile shape shown in the embodiment or each modification, it is possible to provide the same operation and effects as those of the aforementioned embodiment.

(Fourth Modification)

Figure 24:
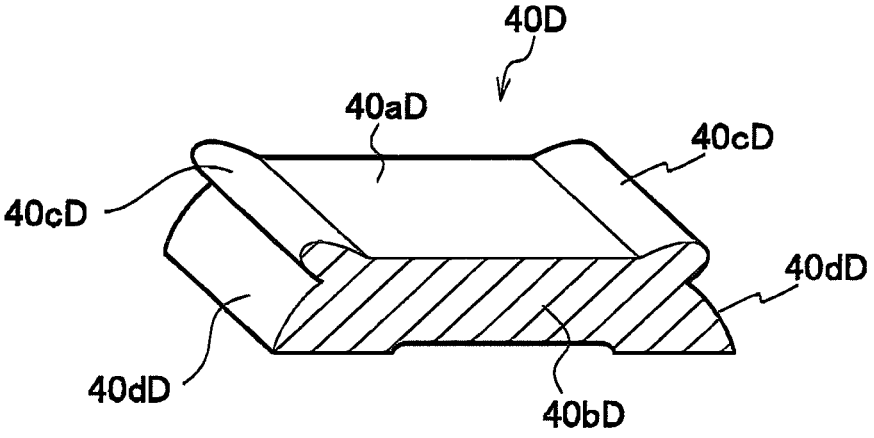
FIG. 24 is a cross-sectional view showing a bar according to a fourth modification of the embodiment of the present invention.

As shown in FIG. 24, a bar 40D according to this modification includes a body portion 40*b*D having a substantially half-barrel shaped cross section. In the skin 70 side (in the upper side in FIG. 24) of the body portion 40*b*D, a substantially flat skin contact surface 40*a*D coming into contact with the skin 70 is formed. At the ends of the body portion 40*b*D in the short-side direction, side surfaces (inner side surfaces facing the blade hole 50 or inner blade 13) 40*d*D, 40*d*D are formed.

At both ends of upper part of the body portion 40*b*D in the short-side direction, a pair of hair raising portions 40*c*D, 40*c*D are formed.

If the bar 40D of such a shape is used and the cross section of the hair raising portion 40*c*D in the bar 40D has a profile shape shown in the embodiment or each modification, it is possible to provide the same operation and effects as those of the aforementioned embodiment.

(Fifth Modification)

Figure 25:
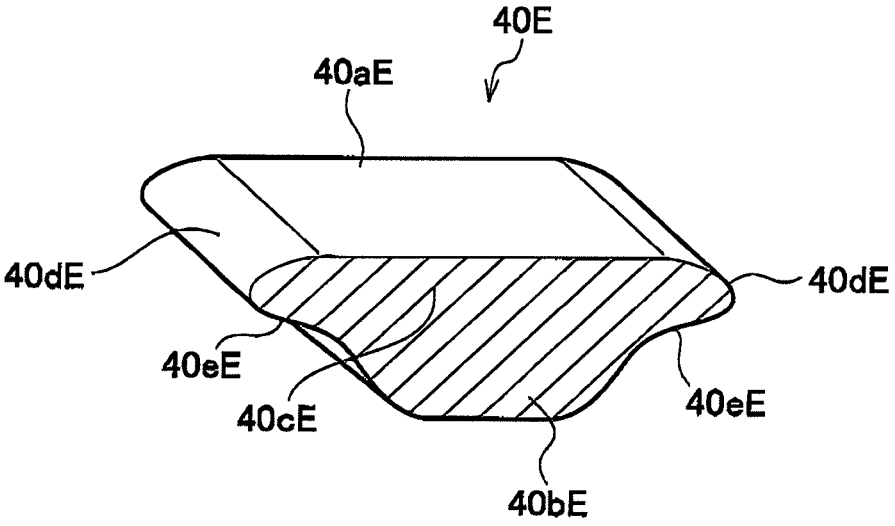
FIG. 25 is a cross-sectional view showing a bar according to a fifth modification of the embodiment of the present invention.

As shown in FIG. 25, a bar 40E according to this modification includes a substantially plate-shaped body portion 40*c*E having a substantially flat skin contact surface 40*a*E which is formed on the skin 70 side (in the upper side of FIG. 25) and comes into contact with the skin 70. A protrusion 40*b*E extending downward from a bottom surface (the inner side surface facing the blade hole 50 or inner blade 13) of the body portion 40*c*E is formed.

At both ends of the body portion 40*c*E in the short-side direction, a pair of hair raising portions 40*d*E, 40*d*E are formed.

If the bar 40E of such a shape is used and the cross section of the hair raising portion 40*d*E in the bar 40E has a profile shape shown in the embodiment or each modification, it is possible to provide the same operation and effects as those of the aforementioned embodiment.

(Sixth Modification)

Figure 26:
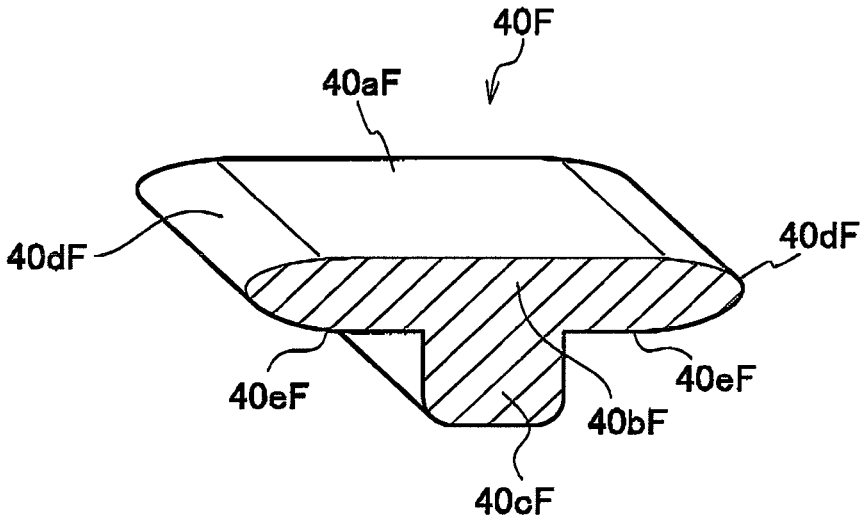
FIG. 26 is a cross-sectional view showing a bar according to a sixth modification of the embodiment of the present invention.

A bar 40F according to this modification has a substantially T-shaped cross section. Specifically, as shown in FIG. 26, the bar 40F includes a substantially plate-shaped body portion 40*b*F having a substantially skin contact surface 40*a*F which is formed on the skin 70 side (in the upper side of FIG. 26) and comes into contact with the skin 70. A protrusion 40*c*F extending downward from a bottom surface 40*e*F (the inner side surface facing the blade hole 50 or inner blade 13) is formed.

At both ends of the body portion 40*b*F in the short-side direction, a pair of hair raising portions 40*d*F, 40*d*F are formed.

If the bar 40F of such a shape is used and the cross section of the hair raising portion 40*d*F in the bar 40F has a profile shape shown in the embodiment or each modification, it is possible to provide the same operation and effects as those of the aforementioned embodiment.

(Seventh Modification)

Figure 27:
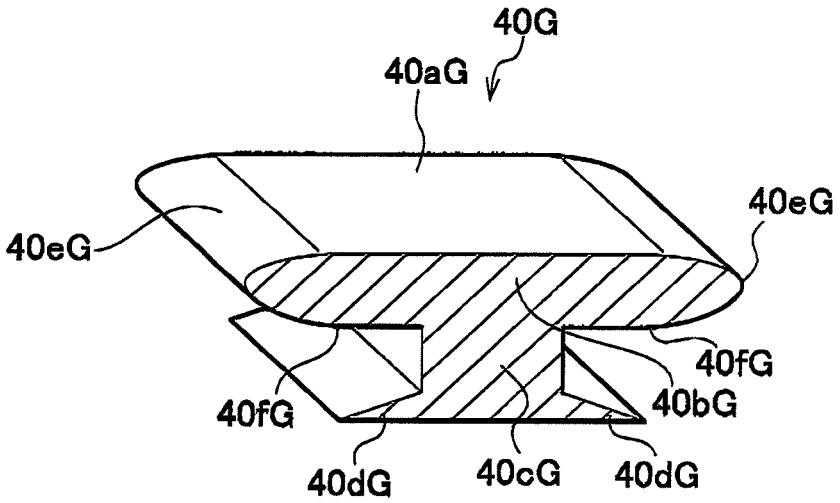
FIG. 27 is a cross-sectional view showing a bar according to a seventh modification of the embodiment of the present invention.

A bar 40G according to this modification has a cross section of a substantially H shape turned sideways. Specifically, as shown in FIG. 27, the bar 40G includes a substantially plate-shaped body portion 40*b*G having a substantially skin contact surface 40*a*G which is formed on the skin 70 side (in the upper side of FIG. 27) and comes into contact with the skin 70. Moreover, a protrusion 40*c*G extending downward from a bottom surface (the inner side surface facing the blade hole 50 or inner blade 13) 40*f*G is formed. Furthermore, extensions 40*d*G, 40*d*G are formed at the bottom end of the protrusion 40*b*G, the extensions 40*d*G, 40*d*G having triangular cross sections and extending toward the both ends in the short-side direction.

At both ends of the body portion 40*b*G in the short-side direction, a pair of hair raising portions 40*e*G, 40*e*G are formed.

If the bar 40G of such a shape is used and the cross section of the hair raising portion 40*e*G in the bar 40G has a profile shape shown in the embodiment or each modification, it is possible to provide the same operation and effects as those of the aforementioned embodiment.

Hereinabove, the preferred embodiment of the present invention is described. However, the present invention is not limited to the aforementioned embodiment, and various changes can be made.

For example, the aforementioned embodiment shows the example where some bars including the hair raising portions having a substantially equal hair raising ability are provided in each top section. However, the hair raising portions of the bars in each top section may be arranged in ascending order of the hair raising ability starting from the center in the right-left direction toward each end.

Moreover, the shapes of the bars are not limited to those shown in the aforementioned embodiment and examples and can be various shapes.

In the aforementioned embodiment, each of the hair raising portions 43*b* of the longitudinal bars 43 is formed by a single arc line. However, the profile shape of the cross-section of the hair raising portion 43*b* may be formed by connecting the blade hole side edge in the cross-sectional line of the skin contact surface and the blade hole side edge in the cross-sectional line of the inner side surface with one linear connecting element or a plurality of connecting elements.

The aforementioned embodiment includes four outer blades arranged side by side. The number of the outer blades may be 1 to 3 or more than 4.

In the aforementioned embodiment, each of the three net blades is provided with the hair raising bars. However, the hair raising bars only needs to be provided for at least any one of the outer blades including the slit blade.

In the aforementioned embodiment, the outer blades are provided for the head section fixed to the grip section. However, the outer blades may be provided for the grip section.

Moreover, the detailed specifications (the shape, size, layout, and the like) of the outer and inner blades, bars, and the like can be properly changed.

What is claimed is:

1. An electric shaver, comprising:

an outer blade comprising a plurality of longitudinal bars extending in a longitudinal direction of the outer blade and lateral bars extending in a lateral direction of the outer blade, wherein the longitudinal bars and lateral bars intersect to define blade holes;

an inner blade which is provided inside of the outer blade and moved relative to the outer blade to cut a body hair inserted into one of the blade holes, wherein the longitudinal bars include a hair raising bar having a hair raising portion raising the body hair, the hair raising bar includes a skin contact surface facing skin, a flat-bottom surface formed on an inner blade side, an inner side surface facing the blade holes and the inner blade, and a hair raising surface connecting the skin contact surface and the inner side surface, a profile shape of a cross section of the hair raising surface is formed by connecting a blade hole side edge in a cross-sectional line of the skin contact surface and a skin side edge in a cross-sectional line of the inner side surface with or a plurality of connecting elements, the plurality of connecting elements comprising at least two arc lines, and to connect the two arc lines of the plurality of connecting elements, the two arc lines are connected with positions of the centers of curvature set different from each other, wherein the inner side surface is inclined.

2. The electric shaver according to claim 1, the plurality of connecting elements further comprising at least two line segments, wherein to connect two of the line segments, the cross-sectional line of the skin contact surface, and the cross-sectional line of the inner side surface, the two line segments are connected with an angle therebetween set not less than 90 degrees but less than 180 degrees.

3. The electric shaver according to claim 1, wherein the cross-section of the hair raising surface has a profile shape in which at least one of the arc lines is positioned on the skin side.

4. The electric shaver according to claim 1, wherein the cross-section of the hair raising surface has a profile shape in which at least one of the arc lines is positioned on the inner blade side.

5. The electric shaver according to claim 1, wherein the cross-section of the hair raising portion has a profile shape in which a distance between connecting points of the connecting elements arranged on the skin side is longer than a distance between connecting points of the connecting elements arranged on the inner blade side.

6. The electric shaver according to claim 1, wherein the cross-section of the hair raising surface has a profile shape in which a distance between connecting points of the connecting elements arranged on the skin side is shorter than a distance between connecting points of the connecting elements arranged on the inner blade side.

7. The electric shaver according to claim 1, wherein a top portion is formed in the skin side of the hair raising surface.

8. The electric shaver according to claim 1, wherein the skin contact surface of the hair raising bar is recessed downward from an outermost surface of the outer blade.

9. The electric shaver according to claim 1, wherein the plurality of connecting elements is defined by arc lines having different curvature radii.

* * * * *